US005262796A

United States Patent [19]

Cachier

[11] Patent Number: 5,262,796

[45] Date of Patent: Nov. 16, 1993

[54] OPTOELECTRONIC SCANNING MICROWAVE ANTENNA

[75] Inventor: Gérard Cachier, Bures S/Yvette, France

[73] Assignee: Thomson - CSF, Puteaux, France

[21] Appl. No.: 897,776

[22] Filed: Jun. 12, 1992

[30] Foreign Application Priority Data

Jun. 18, 1991 [FR] France ..... 91 07422

[51] Int. Cl.[5] ..... H01Q 3/26; H01Q 3/46

[52] U.S. Cl. ..... 343/909; 343/753

[58] Field of Search ..... 343/909, 756, 701, 753, 343/755; 359/72

[56] References Cited

U.S. PATENT DOCUMENTS

| | | | |
|---|---|---|---|
| 4,028,556 | 6/1977 | Cachier et al. | 307/205 |
| 4,054,875 | 10/1977 | Cachier | 343/701 |
| 4,126,932 | 11/1978 | Cachier | 29/580 |
| 4,152,718 | 5/1979 | Cachier | 357/56 |
| 4,197,546 | 4/1980 | Cachier et al. | 343/701 |
| 4,278,951 | 7/1981 | Cachier et al. | 331/96 |
| 4,280,110 | 7/1981 | Cachier et al. | 331/107 R |
| 4,306,312 | 12/1981 | Cachier | 331/42 |
| 4,333,076 | 6/1982 | Cachier | 333/137 |
| 4,479,131 | 10/1984 | Rogers et al. | 343/909 |
| 4,876,239 | 10/1989 | Cachier | 505/1 |
| 5,014,069 | 5/1991 | Seiler et al. | 343/785 |

FOREIGN PATENT DOCUMENTS 442562 8/1991 European Pat. Off. .

2225122 5/1990 United Kingdom .

OTHER PUBLICATIONS

Patent Abstracts of Japan, vol. 13, No. 97 (E-723) (3445) Mar. 7, 1989 & JP-A-63 269 807.

*Primary Examiner*—Donald Hajec
*Assistant Examiner*—Hoanganh Le
*Attorney, Agent, or Firm*—Pollock, Vande Sande & Priddy

[57] ABSTRACT

The antenna is provided with an array of optically controlled elementary reflectors with phase-shifters. The array of elementary reflectors comprises a substrate made of a dielectrical material with low microwave losses, transparent to light, the substrate being coated, on the side exposed to the microwaves, with a layer of photoconductive elements distributed in an array and, on the opposite side, with a conductive electrode transparent to light. An optical system for the selective illumination of the photoconductive elements are used to make these elements go from an electrically insulating state to a conductive state and vice versa to modify the path of the microwave within the reflectors and enable the formation of the beam. The array of photoconductive elements forms a lattice of smaller meshes subdividing the lattice of the array of elementary reflectors. Thus, each elementary reflector brings together several photoconductor elements, a varyingly large proportion of which may be illuminated, thus giving it different possible phase states.

5 Claims, 3 Drawing Sheets

OPTOELECTRONIC SCANNING MICROWAVE ANTENNA

BACKGROUND OF THE INVENTION

1. Field of the Invention

The present invention relates to a microwave antenna which, for the aiming of its beam, uses an array of elementary reflectors with active elements capable, as desired and upon activation by an optical command, of modifying the length of the path of penetration of the microwaves into the reflectors of the array to generate phase shifts varying from one elementary reflector to another and to provide for the aiming of the antenna beam.

2. Description of the Prior Art

A known antenna of this type has a reflector made out of a substrate of a dielectric material with low microwave losses, transparent to light, such as silicon dioxide $SiO_2$ or crystallized alumina $Al_2O_3$. On the side exposed to the microwaves, this substrate is coated with photoconductive elements that are insulated from one other by an electrically insulating material, these photoconductive elements being possibly covered with an opaque layer transparent to microwaves and arranged in on array with an lattice spacing equal to $\lambda/2$ to prevent multiple angles of reflection, $\lambda$ being the wavelength of the microwaves considered. On the opposite side, which is not exposed to the microwaves, it is coated with a electrode that is transparent to light, made of an electrically conductive material such as tin oxide.

The photoconductive elements, which may be made of "intrinsic"silicon, i.e. insulating silicon, are illuminated or not illuminated through the substrate and the transparent electrode, for example by means of a liquid crystal screen placed flat against the substrate and illuminated by a light source. When they are illuminated, they become electrically conductive and reflect the microwaves before these have penetrated the substrate. When they are not illuminated, they are electrically insulating and let the microwaves pass through them. These microwaves go through the substrate and get reflected on the transparent electrode. If the delay in propagation through the thicknesses of the photoconductive elements and of the substrate is close to an odd number of quarter periods of the microwave, the phase shift between the case where the microwaves encounter an illuminated photoconductive element and the case where they encounter a non-illuminated photoconductive element is $\pi$.

Thus, an array of elementary reflectors is made, with a lattice spacing equal to half the wavelength of the microwaves, each of which is capable of generating, as desired, phase shifts of 0 or $\pi$ upon activation by an optical command. However, if high gain of a scanning microwave antenna is to be achieved and the minor lobes and scattering are to be maintained at acceptable levels, it is generally necessary to use a controllable phase-shifter with more than two phase states at each elementary reflector.

To meet this requirement, it has been proposed to stack layers of photoconductive silicon and low loss dielectric substrate before the transparent conductive electrode to present the microwave, within each elementary reflector, with different paths of staggered lengths that correspond to various values of phase shift between 0 and $2\pi$ and are a function of the depth, in the stack, of the first layer of photoconductive silicon made conductive by illumination. Difficulties then arise for the selective illumination of the different layers of photoconductive silicon which mask one another.

The present invention is aimed at overcoming these difficulties and at making it possible to obtain controllable phase-shifters with more than two phase-states in an array of reflectors for microwaves while, at the same time, preserving a simple three-layered structure for the array of reflectors, said structure being formed by a substrate made of a dielectrical material with low losses transparent to light, said substrate bearing an array of photoconductive elements on the side exposed to the microwaves and a conductive electrode transparent to light on the other side.

SUMMARY OF THE INVENTION

An object of the invention is an optoelectronic scanning microwave antenna provided, firstly, with an array of optically controlled elementary reflectors with phase-shifters comprising a substrate made of a dielectrical material with low microwave losses, transparent to light, said substrate being coated, on the side exposed to the microwaves, with a layer of photoconductive elements distributed in an array and, on the opposite side, with a conductive electrode transparent to light and, secondly, with means for the selective illumination of the photoconductive elements, capable of making these elements go from an electrically insulating state to a conductive state and vice versa. This antenna is noteworthy in that the array of photoconductive elements forms a lattice of smaller meshes sub-dividing the lattice of the array of elementary reflectors. Thus, each elementary reflector brings together $n^2$ photoconductor elements, n being the lattice sub-dividing rate, a varyingly large proportion of which is illuminated, thus giving it different phase states that are staggered from a minimum value, obtained when all its photoconductive elements are illuminated, up to a maximum value obtained when all its photoconductive elements are in darkness.

BRIEF DESCRIPTION OF THE DRAWINGS

Other features and advantages of the invention shall emerge from the description of an embodiment given by way of an example. These descriptions are made here below, with reference to the appended drawings, of which.

MORE DETAILED DESCRIPTION

Figure 1:
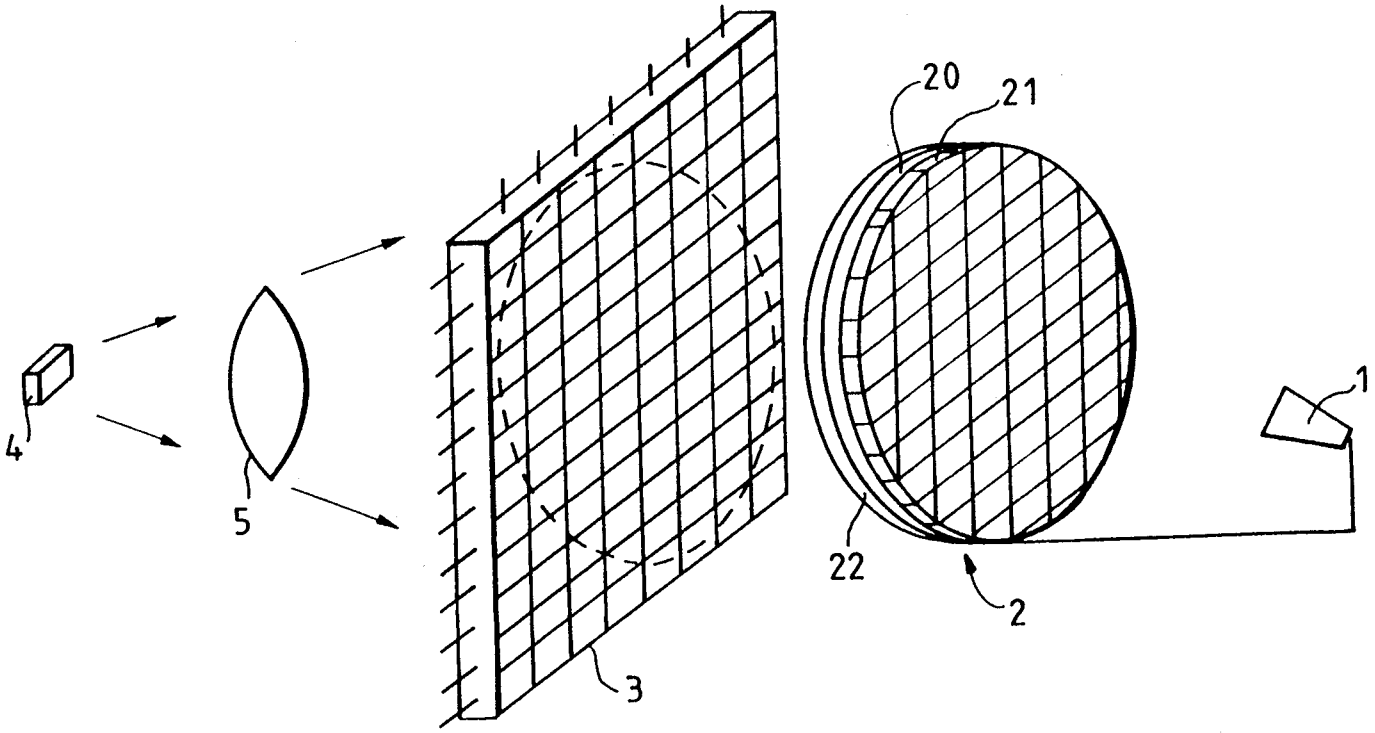
FIG. 1 shows a schematic and partially disassembled view of an optoelectronic scanning microwave antenna according to the invention.

The microwave antenna shown in FIG. 1 works in the region of 94 GHz. It has a horn 1 that illuminates a planar array 2 of elementary reflector with microwave energy. This planar array 2 is placed before a liquid crystal screen 3 illuminated by a light source 4 through an optical focusing unit 5.

The array of elementary reflectors takes the form of a flat disk with a diameter of about 10 cm. It is formed by a substrate 20, made of a dielectric material with low microwave losses, transparent to light, such as silicon dioxide $SiO_2$ or crystallized alumina $Al_2O_3$. On the side facing the horn 1, which is exposed to the microwaves, this substrate 20 has a layer 21 of photoconductive elements such as silicon or gallium arsenide which are insulated from one another and distributed on the surface of the substrate so as to form a smaller-meshed lattice sub-dividing the lattice of an array of elementary reflectors with a spacing of $\lambda/2$, here about 1.5 mm. On the side opposite the horn 1, the substrate 20 is coated with a conductive electrode 22 transparent to light which is, for example, made of tin oxide.

The liquid crystal screen 3 is placed flat against the conductive electrode 22 of the substrate 20. It comprises an array of pixels that faithfully reproduce the distribution of the photoconductive elements 21 borne by the substrate 20. These pixels, upon activation, can be made either transparent or opaque in order to selectively prompt the illumination of the photoconductive elements placed in a position of extension with respect to said pixels.

The light source 4 may be an array of electroluminescent diodes or of laser diodes giving a power of 30 to 50 Watts continuously at a wavelength of about 0.8 $\mu$m. The light intensity reaching a photoconductive element made of silicon, when the pixel of the liquid crystal screen associated with it is transparent, is then sufficient to make said element conductive.

Figure 2:
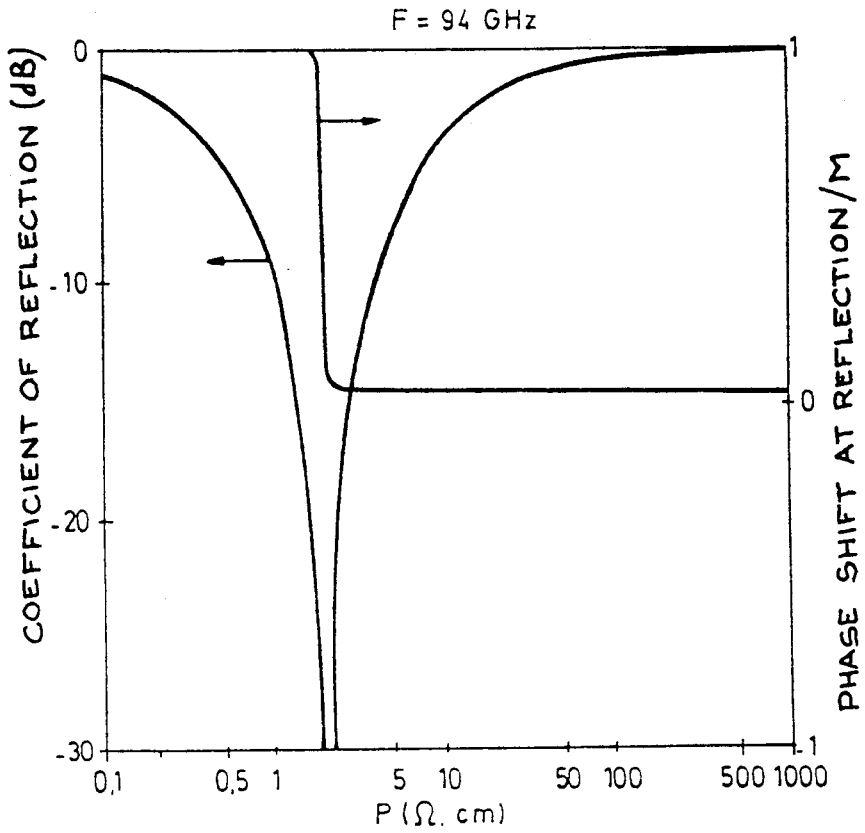
FIG. 2 is a graph that represents the variations of the reflection coefficient at normal incidence and of the phase shift at reflection, as a function of resistivity, for silicon used as a photoconductor.

FIG. 2 shows the variations of the coefficient of reflection under normal incidence and of the phase shift at reflection, as a function of resistivity, for silicon used as a photoconductor. It shows that it is possible to go from total reflection to an almost total transmission of the microwaves with silicon, the resistivity of which varies from about 0.1 ohm.cm to more than 1000 ohm.cm as a function of its illumination. FIG. 2 also shows that there is a condition of illumination for which the silicon completely absorbs the microwaves. This effect may be used to make an antenna absorbent, hence furtive with respect to a detection system.

Figure 3:
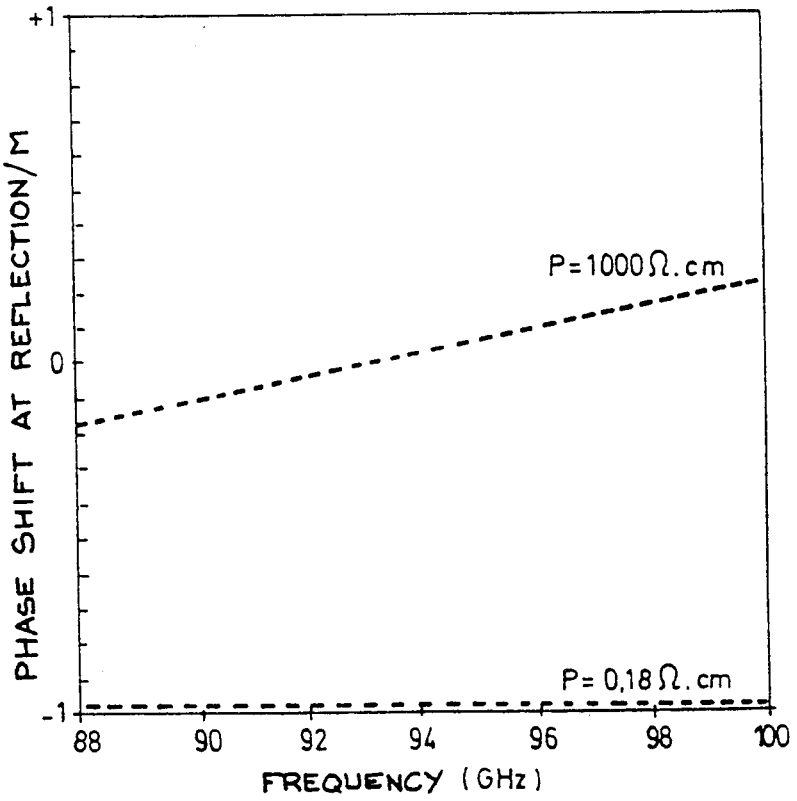
FIG. 3 is a graph that represents the variations of the phase shift at transmission and at reflection of the silicon as a function of the frequency.

FIG. 3 shows the frequency response of the phase shift at transmission (P = 1000 ohm.cm) and at reflection (P = 0.18 ohm.cm) of silicon. It shows that the phase shift at transmission is practically zero for a 94 GHz microwave.

Figure 4:
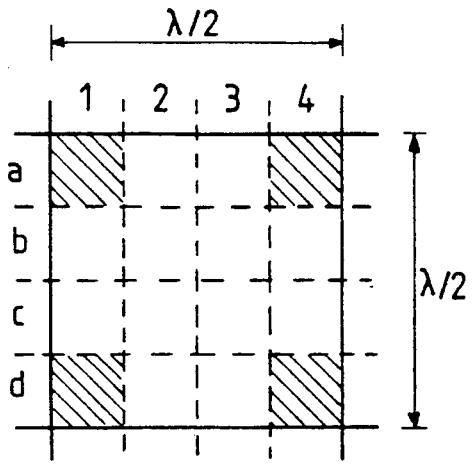
FIG. 4 illustrates an example of the distribution of photoconductive elements on the surface of an elementary reflector of the antenna shown in FIG. 1.

FIG. 4 shows an example of the distribution of the photoconductive elements on the surface of the substrate 20. These photoconductive elements form a smaller-meshed lattice sub-dividing the lattice of the array of elementary reflectors that has a spacing of $\lambda/2$, represented by solid lines. This sub-dividing is done with a lattice, represented by dashed lines, having a mesh that is four times smaller. Thus, each elementary reflector is formed by a checker board of 16 photoconductive elements 1*a*, . . . , 4*d* that can be illuminated individually by means of the pixels of the liquid crystal screen so that they can be made insulating or conductive as desired. It is then possible to choose a variable shape of the illuminated photoconductive surface in each elementary reflector to define a variable phase. This amounts to the introduction, into a microwave waveguide formed by the contour of an elementary reflector, of a conductive iris which is equivalent to a susceptance, the phase in reflection of which can be computed. This variable susceptance may be the same for several microwave polarizations if these polarizations encounter equivalent surface areas.

For example, a horizontal polarization and a vertical polarization undergo the same phase shift if the photoconductive surface that is made conductive has a shape that it keeps in a $\pi/2$ rotation.

In the example illustrated by FIG. 4, where an elementary reflector is constituted by a checker-board of 16 photoconductive elements 1*a*, . . . , 4*d*, it is possible to adopt five different configurations that are kept in a $\pi/2$ rotation;

a first configuration where no photoconductive element is illuminated;

a second configuration, which is the one shown, where only the corner photoconductive elements 1*a*, 4*a*, 4*d* and 1*d* are illuminated;

a third configuration where the photoconductive elements 2*a*, 4*b*, 3*d* and 1*c* are illuminated in addition to the corner photoconductive elements 1*a*, 4*a*, 4*d* and 1*d*;

a fourth configuration where all of the photoconductive elements of the periphery, 1*a*, 2*a*, 3*a*, 4*a*, 4*b*, 4*c*, 4*d*, 3*d*, 2*d*, 1*d*, 1*c*, and 1*b* are illuminated;

a fifth configuration where all the photoconductive elements are illuminated.

If the thicknesses of the photoconductive elements and of the substrate are of the order of half of the wavelength of the microwaves used, a two bit controlled phase-shifter, independent of the polarization, is obtained with the latter four configurations.

Naturally, it is possible to adopt a lower lattice sub-dividing rate, for example with a value of two or three, in which case there will then be a smaller choice of configurations. Similarly, it is possible to adopt a higher lattice sub-dividing rate, in which case there will then be a greater choice of configurations. However, in the latter case, manufacturing difficulties will arise owing to the small size of the photoconductive elements and of the pixels of the liquid crystal screen that have to correspond to them.

What is claimed is:

1. An optoelectronic scanning microwave antenna including an array of optically controlled elementary reflectors comprising:

a substrate made of dielectric material with low microwave losses and transparent to light;

the substrate coated, on a side exposed to an incident microwave beam, with a layer of photocontuctive elements distributed in an array, the elements spaced apart by $\lambda/2$;

the opposite side of the substrate mounting a transparent conductive electrode;

each of the elements having a matrix of photoconductive cells; the antenna further including— means located in spaced relation to the reflector array and opposite the incident microwave beam, for illuminating preselected cells of the photoconductive matrix.

2. The antenna set forth in claim 1 wherein each photoconductive matrix comprises 4 rows and 4 columns of cells.

3. The antenna set forth in claim 1 wherein the preselected illumination of the photoconductive matrix cells form configurations of conductive cells and electrically insulating cells that remain the same when the matrix cells are rotated $\pi/2$.

4. An optoelectronic scanning microwave antenna including an array of optically controlled elementary reflectors comprising:

a substrate made of dielectric material with low microwave losses and transparent to light;

the substrate coated, on a side exposed to an incident microwave beam, with a layer of photoconductive elements distributed in an array;

the opposite side of the substrate mounting a transparent conductive electrode;

each of the elements having a matrix of 4 rows and 4 columns of photoconductive cells; the antenna further including— means located in spaced relation to the reflector array and opposite the incident microwave beam, for illuminating preselected cells of the photo conductive matrix.

5. An optoelectronic scanning microwave antenna including an array of optically controlled elementary reflectors, comprising:

a substrate made of dielectric material with low microwave losses and transparent to light;

the substrate coated, on a side exposed to an incident microwave beam, with a layer of photoconductive elements distributed in an array;

the opposite side of the substrate mounting a transparent conductive electrode;

each of the elements having a matrix of photoconductive cells; the antenna further including— means located in spaced relation to the reflector array layer, and opposite the incident microwave beam, for illuminating preselected cells of the photoconductive matrix;

the preselected illumination of the photoconductive matrix cells forming configurations of conductive cells and electrically insulating cells remain the same when the matrix cells are rotates $\pi/2$.

* * * * *